US006203186B1

(12) United States Patent
Cruz

(10) Patent No.: US 6,203,186 B1
(45) Date of Patent: Mar. 20, 2001

(54) SPHERICAL EDUCTOR ATOMIZER

(76) Inventor: Luis R. Cruz, Roosevelt 2246, Piso 2-B, 1428 Buenos Aires (AR)

( * ) Notice: Subject to any disclaimer, the term of this patent is extended or adjusted under 35 U.S.C. 154(b) by 0 days.

(21) Appl. No.: 09/394,858

(22) Filed: Sep. 13, 1999

(51) Int. Cl.[7] ..... B01F 5/04; B05B 7/30

(52) U.S. Cl. ..... 366/163.2; 366/181.5; 366/338; 239/425; 239/425.5; 239/432

(58) Field of Search ..... 366/163.1, 163.2, 366/167.1, 173.1, 173.2, 174.1, 175.2, 181.5, 336, 338; 138/37, 40; 137/888, 891, 896; 239/343, 344, 424, 424.5, 425, 425.5, 428.5, 432

(56) References Cited

U.S. PATENT DOCUMENTS 2,538,948 * 1/1951 Richards .
3,031,147 * 4/1962 Goodrie .
3,677,522 * 7/1972 Hargash .
3,735,778 * 5/1973 Garnier .
3,799,195 * 3/1974 Hermans .
4,116,382 * 9/1978 Clerk .
4,343,434 * 8/1982 Haruch .
4,592,506 * 6/1986 Capes et al. .
4,932,591 * 6/1990 Cruz .
5,860,598 * 1/1999 Cruz .
5,992,529 * 11/1999 Williams .

* cited by examiner

*Primary Examiner*—Charles E. Cooley
(74) *Attorney, Agent, or Firm*—James G. O'Neill

(57) ABSTRACT

A fluid mixing device includes a nozzle having a first element mounted therein, and connected to a hollow, tubular element having a series of openings formed therein adjacent the first element. The hollow, tubular element extends outwardly from the nozzle, through an exit opening and may have a second element mounted thereon. The second element may take various shapes, including having a number of protrusions thereon, to vary the atomization of fluid flowing from the nozzle exit. An outer end of the hollow, tubular element may be free to suck in atmosphere, or may be attached to a tube immersed in a container, to draw in a second fluid to mix with the first fluid through the nozzle.

19 Claims, 4 Drawing Sheets

SPHERICAL EDUCTOR ATOMIZER

BACKGROUND OF THE INVENTION

1. Field of the Invention

This invention relates generally to fluid flow devices, and more particularly, to an improved fluid flow mixing device, which produces a pulling or suction effect over a device by a fluid stream moving through a convergent-divergent or a convergent nozzle.

2. Description of the Prior Art

The majority of presently known fluid flow mixers work by using a plurality of concentric, hollow, cylindrical ducts or tubes, which are axially aligned with respect to each other. The concentric ducts or tubes have different diameters and lengths, whereby, when fluid is flowing inside these tubes, a first fluid discharged from the smaller diameter tube travels at a higher speed into the larger diameter tube, to thereby pull or suck a second fluid through an opening formed above the surface of the inner tube. Due to the large change in cross sectional area between the smaller and larger diameter tubes, a loss in pressure is produced. Furthermore, because there is only one opening for drawing in the second fluid, the mixing of the fluids together, especially in the beginning, is not uniform. Additionally, the smaller diameter tube must be longer than the larger diameter tube, so as to accelerate the fluid flowing inside.

SUMMARY OF THE INVENTION

Accordingly, it is a general object of the present invention to provide an improved and simplified mixing device. It is a particular object of the present invention to provide an improved mixing device in which a high speed fluid flow passes over a first element formed from a spherical body of revolution, which spherical body of revolution is held in a convergent nozzle. It is a more particular object of the present invention to provide improved fluid flow expansion, between a divergent nozzle part and a hollow, cylindrical element held in the nozzle. It is a still further particular object of the present invention to change the direction of fluid flow in a mixing device by the action of a smooth annular connection, which annular connection joins a cylindrical element with a second element formed from a convex body of revolution, outside of a nozzle, adjacent to an exit of the nozzle. It is yet another particular object of the present invention to expand a fluid flow over a convex body of revolution outside of a nozzle exit. It is yet a still further object of the present invention to produce a drawing or sucking by the action of a fluid flow over a spherical mixing device held within a convergent-divergent nozzle. It is yet another object of the present invention to draw a second fluid into a first fluid within an annular nozzle, which nozzle is formed by a convergent-divergent system and a spherical mixing device therein. It is yet a still further particular object of the present invention to produce a uniform mixing of different fluids from the beginning, between a main fluid flow and a secondary fluid flow drawn into the main fluid flow. It is a still further particular object of the present invention to atomize a mixed fluid flow, over a second convex body of revolution, outside an exit opening of a nozzle. It is yet a still further particular object of the present invention to mix an atomizing fluid flow with surrounding air by using a cylindrical sleeve placed around a nozzle and a second body of revolution, which second body of revolution is provided with a series of circular openings formed around its periphery, adjacent to an exit of a nozzle. It is yet a still further particular object of the present invention to reduce the size and weight of a mixing device that is formed as part of an annular nozzle, wherein the drawing or pulling of a second fluid is made through a series of circular openings formed around the periphery of a hollow, cylindrical section, which section. It is yet a still more particular object of the present invention to provide for the mixing of a plurality of fluids in a more consistent manner so as to be capable of being used in open and hot places. It is yet a still further particular object of the present invention to produce a mixing of a plurality of fluids at various pressures in a line. It is a still further particular object of the present invention to provide a fluid flow mixing device in which various diameter bodies are provided outside of a convergent nozzle so as to obtain a desired flow pattern. It is still yet a further particular object of the present invention to produce a mixing and fluid flow expansion of a plurality of fluids in a constant cross section nozzle having a hollow, cylindrical portion therein. And, it is a final further particular object of the present invention to produce fluid mixing and fluid flow expansion between a convergent nozzle throat portion and a hollow, cylindrical element held therein.

The present invention overcomes the problems with prior art devices, by making use of a mixing device, which includes a first body having the shape of a convex body of revolution with a semi-spherical form. This device is mounted in a convergent nozzle, and the fluid flow through the nozzle is accelerated to a maximum speed, because of the decrease in nozzle area at a throat area, after an expansion inside the nozzle in a hollow, cylindrical section and a divergent nozzle portion. This expansion of the fluid also occurs over a second element, having the shape of a convex body of revolution, after the mixed fluids exit the nozzle. That is, the device of the present invention produces a total expansion of fluids greater that with known systems. A second fluid is pulled or sucked into a first fluid after the flow of fluid has accelerated in the nozzle, by the action of a series of openings, formed peripherally around the outside surface of a hollow, cylindrical element aligned with the flow of the first fluid, along a longitudinal axis of the nozzle. This causes a uniform drawing or sucking in of a second fluid into the interior of the first fluid stream. Therefore, in a selected case, the second fluid being drawn in enters around the internal surface of the first fluid stream flowing through the nozzle. The second convex body of revolution is provided with an external, cylindrical sleeve, and a series of circular openings are formed through its surface, adjacent the nozzle exit, thereby allowing the expanding fluid flow to mix with surrounding air, to improve the atomization of the mixed fluid flow.

Additionally, the present invention may use a convergent nozzle with the nozzle followed by an elongated, cylindrical element of constant diameter, which constant diameter is the same as the diameter of the nozzle throat section, and the elongated, cylindrical element may selectively have a second convex body of revolution.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENT

The following description is provided to enable any person skilled in the art to make and use the invention, and sets forth the best modes contemplated by the inventor of carrying out his invention. Various modifications, however, will remain readily apparent to those skilled in the art, since the generic principles of the present invention have been defined herein, specifically to provide for a novel and improved, simplified eductor or device for mixing a plurality of fluids, or a fluid with surrounding air, and then atomizing or forming a fog from the mixed fluids.

A known type of fluid atomizer is set forth in Applicant's U.S. Pat. No. 4,932,591 ("'591") and a known type of fog atomizer is shown in Applicant's U.S. Pat. No. 5,860,598 ("'598"). The disclosures of the '591 and '598 patents are incorporated herein, in their entireties, by this reference thereto.

Figure 1:
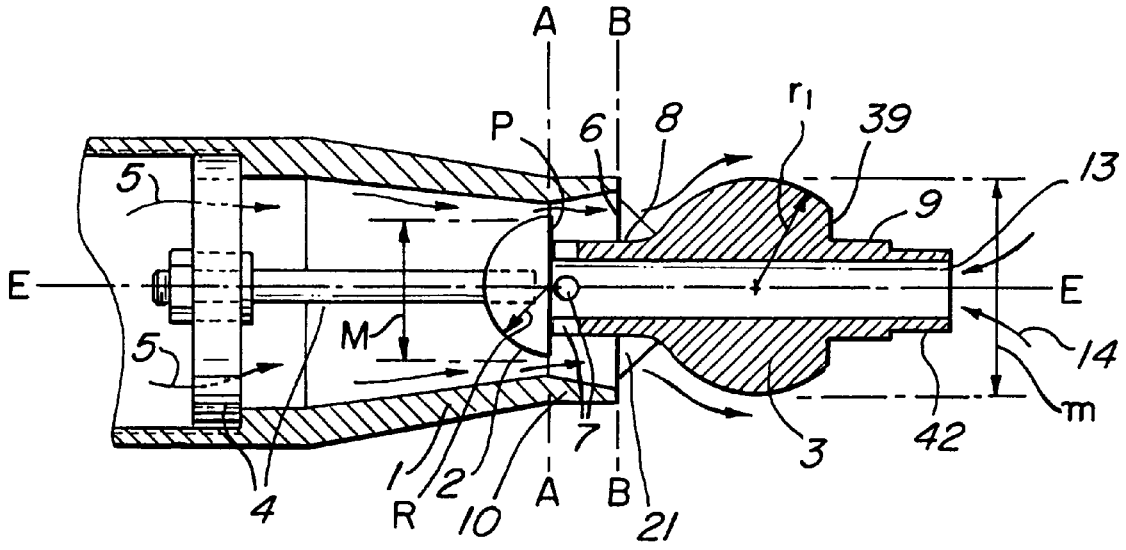
FIG. 1 is a cross sectional view of a first embodiment of the device of the present invention, having a first convex body of revolution axially aligned within a hollow, cylindrical section, which hollow, cylindrical section has a series of openings formed peripherally therein; the device includes a second convex body of revolution, which is placed adjacent an exit of the nozzle.
Figure 5B:
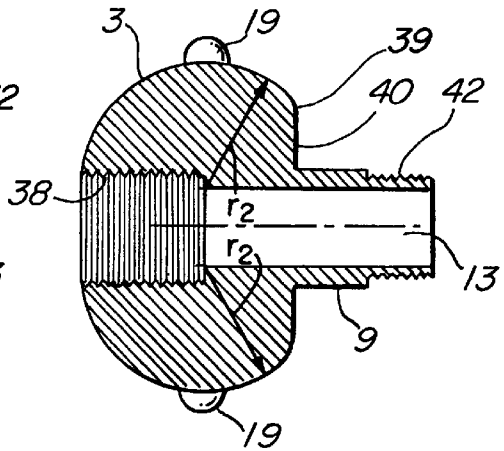
FIGS. 5–5B are cross sectional views of further embodiments of the device of the present invention having different sized and shaped second elements, which may include different surface configurations.
Figure 5A:
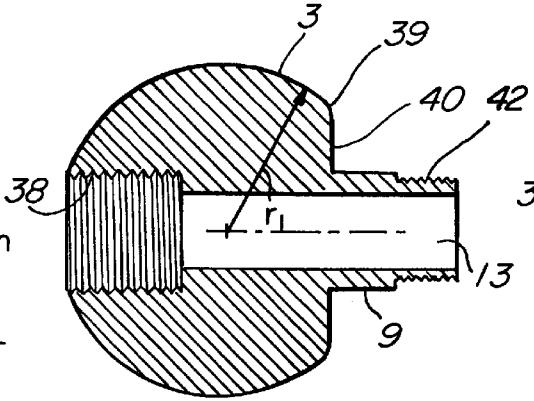
Figure 5:
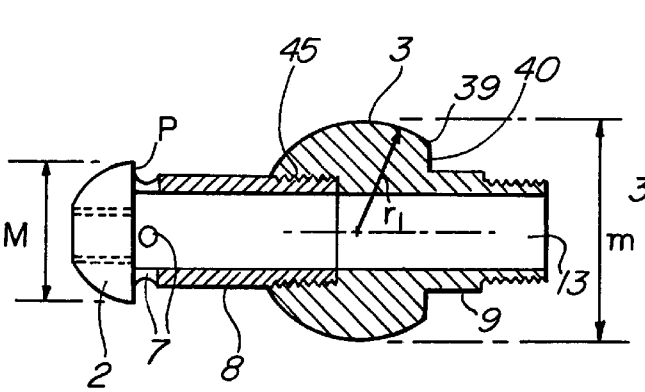

Referring now to FIG. 1, there shown is a convergent-divergent nozzle 1 of the type set forth in the '598 patent, including supporting elements 4. Inserted in and axially aligned with the longitudinal axis of the convergent-divergent nozzle 1 are a pair of elements 2, 3, preferably formed as convex bodies of revolution. The first element 2 and the second element 3 cooperate with a hollow, cylindrical element or tubular portion or section 8, which connects the two elements. The first element 2 preferably includes a semi-circular front portion or surface or radius "R" and a flattened rear portion or surface "p". This rear portion has a maximum diameter "M" with a radius "R". The flattened rear portion "p" is preferably aligned with a throat section of the nozzle, as indicated by line or plane A—A. The exit section of the nozzle is indicated by line or plane B—B. After the exit, the conical shape of the second element 3 is indicated by line or plane C—C (see FIG. 2). The hollow, cylindrical portion 8 contacts or is joined to the second element 3, by a smooth joint 21, such as an annular faring. That is, the hollow, cylindrical section 8 and the second element 3 are smoothly connected to prevent turbulence. The second element 3 is preferably formed as a spherical body, having a radius "r1 or r2". As best shown in FIGS. 5–5B, the second element 3 may include a smooth or rounded rear end 39 jointed to a flat rear surface 40, which is preferably perpendicular to a longitudinal axis E—E of the nozzle, and includes a tubular portion 9 connected thereto.

A first fluid 5 is shown by the arrows as flowing inside the annular nozzle 1 around the first element 2, and through the narrow throat section of the nozzle, as indicated by plane A—A. The first fluid 5 is accelerated to a maximum velocity "V" at the throat. After passing plane A—A, the first fluid is expanded by the increased nozzle area indicated by the divergent nozzle portion 10. This expansion of the first fluid 5 causes a drop in pressure starting at the maximum diameter "M" of the first element 2, thus drawing, pulling or sucking a second fluid, such as surrounding air 14, or fluid 35, through a hollow, internal passage 13 and circular openings 7 formed around the cylindrical section 8. As shown by the arrows in FIGS. 1 and 2, the first fluid 5 draws or pulls the second fluid 14 or 35 into itself, through the series of openings 7. The openings 7 are preferably formed around the periphery of the exterior surface of the hollow, cylindrical section 8, adjacent to the rear surface "p". After passing out of the exit 6 of the nozzle, at plane B—B, the mixed stream of fluids 5 and 14 or 35, reaches the smooth portion 21, and passes over the second element 3. This passage over element 3 changes the direction of the fluid stream, since it must follow the frontal, curved portion of the body of element 3, as indicated by the conical plane C—C. Therefore, the expansion of the fluid stream continues over the second element's surface.

Figure 1A:
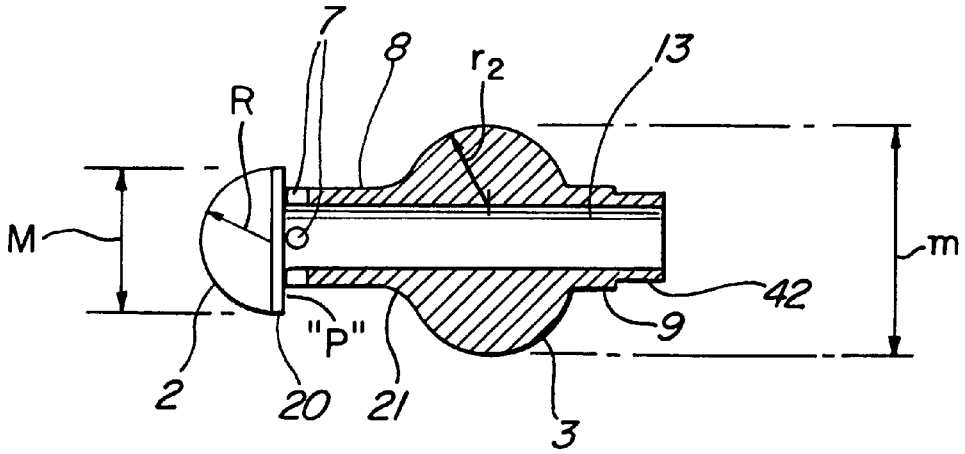
FIG. 1A is a partial cross sectional view of a second embodiment of the mixing device of the present invention, showing a different shaped, first element and a different shaped second element.

Referring now to FIG. 1A, there shown is a further embodiment of the mixing device of the present invention in which the first element 2 has a semi-spherical body shape, secured or connected to a cylindrical rear portion 20, having the same maximum diameter "M". In this further embodiment, the second body 3 is formed as an annular body of revolution, having a radius "r2". That is, the second body 3 has a substantially spherical body.

Figure 2:
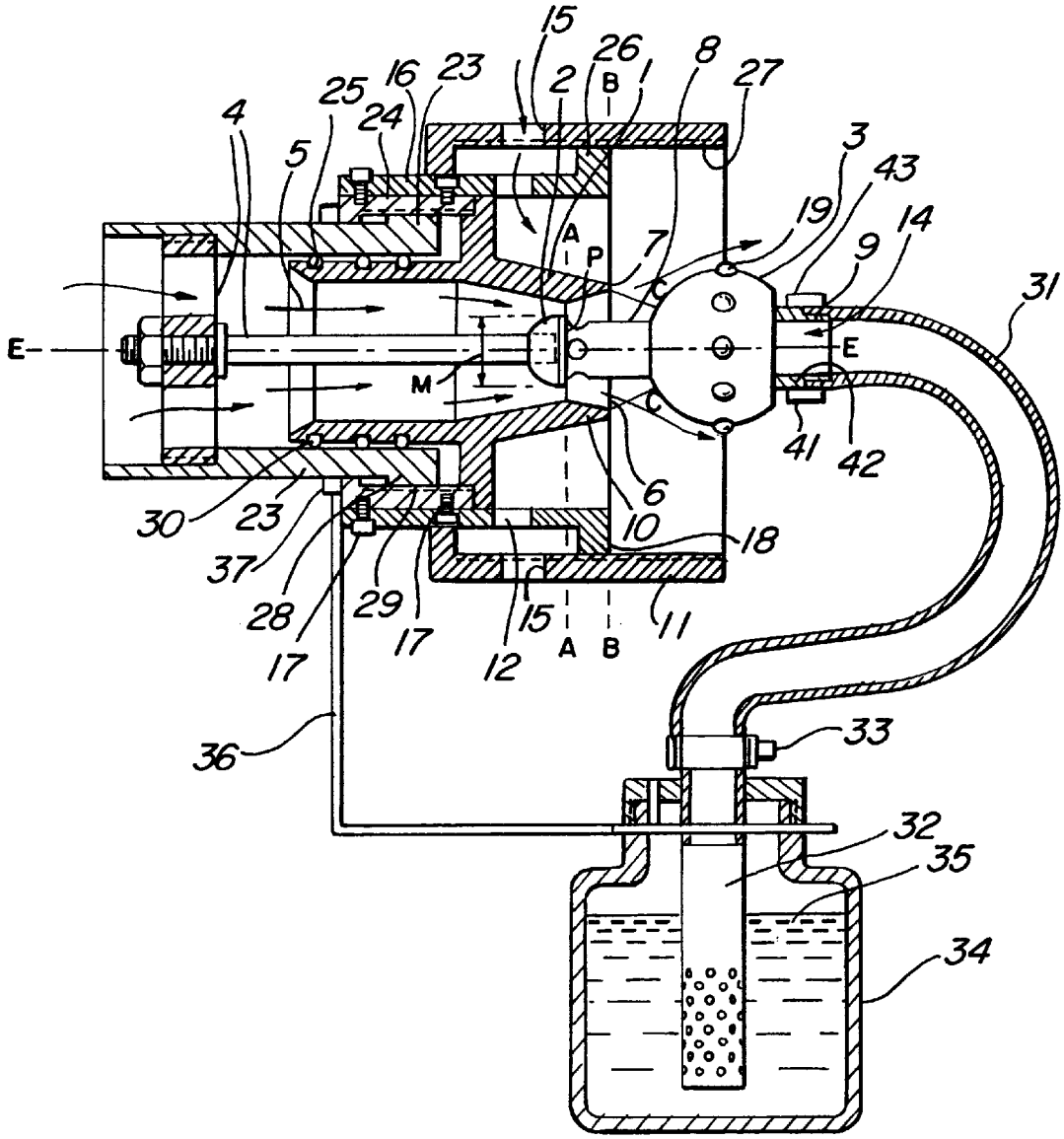
FIG. 2 is an enlarged cross sectional view of a system utilizing the mixing device of the present invention, held within a convergent-divergent nozzle so as to mix two fluids coming from two different directions, and includes a cylindrical sleeve surrounding and protecting the nozzle and a second element so as to improve the atomization of the mixed fluids.

In FIG. 2, the convergent-divergent nozzle 1 is shown as being adjustably mounted, with respect to the rear surface "p" of the first element 2, so as to vary the position of the nozzle throat area, identified by the plane A—A. By moving the nozzle throat portion, with respect to the mixing device, the flow of fluid therethrough may be modified, but it will still have a drawing or pulling effect on a second fluid, within the nozzle. The nozzle 1 is moved axially along longitudinal axis E—E by rotating a cylindrical element 24 either clockwise or counterclockwise. If the cylindrical element 24 is rotated in one direction, the nozzle will be moved along axis E—E, inwardly or left, when looking at FIG. 2, and the throat area will be increased, thereby allowing larger flow rates. Rotating the cylindrical element 24 in the other direction produces an axial movement outwardly, toward the nozzle's exit, or to the right, when looking at FIG. 2, thus causing a sudden change in the cross sectional area between the throat of the nozzle and the first element 2, thereby greatly increasing the fluid flow rate therethrough. In either case, there will still be a drawing or pulling effect inside the nozzle by action of the mixing device of the present invention.

FIG. 2 also shows an outer cylindrical sleeve composed of two hollow, cylindrical portions or sleeves 11, 16. The first hollow, cylindrical portion 16 is smaller, or of a lesser diameter, and is fixed to the nozzle body 24 by a plurality of screws 17. The first, hollow, cylindrical portion 16 includes screw threads 26 formed on a top surface 18 thereof, and a series of apertures 12 formed around its periphery. The outer, larger diameter, cylindrical sleeve 11 also has a further series of apertures 15 formed therein. The external, cylindrical sleeve 11 may be rotated either clockwise or counterclockwise to move along the longitudinal axis E—E of the nozzle 1, to either cover or uncover the second element 3, and thereby produce a different fluid flow pattern over the second element, so as to provide different spray fluid flow patterns. When the outer, cylindrical sleeve 11 is moved to the right, as shown in FIG. 2, to its outer limit position, the second element 3 is entirely covered, whereby, if a fluid is flowing from the nozzle at a given pressure, a reduced volume of atomized or fog jet fluid flow would be produced. On the other hand, when the exterior, cylindrical sleeve 11 is moved to the right, to its inner limit position, the second element 3 will be uncovered, and a greater volume of atomized or fog fluid flow would be obtained.

FIG. 2 also shows a cylindrical section 23, having an annular exteriorly threaded portion 28, which is held in internal threads 29 formed on an internal surface of the cylindrical body 24. A plurality of O-ring seals 30 are provided therein to prevent any fluid leakage from within the nozzle. Holding elements, such as structural screws 17, are used to fix the cylindrical sleeve 16 to the cylindrical nozzle body 24, and to prevent or stop the cylindrical sleeve 11 from passing by its inner limit position. The internal cylindrical sleeve 16, including the annular top portion 18, having the screw threads 26 formed thereon, moves over internal screw threads 27 formed on the external cylindrical sleeve 11.

Figure 4:
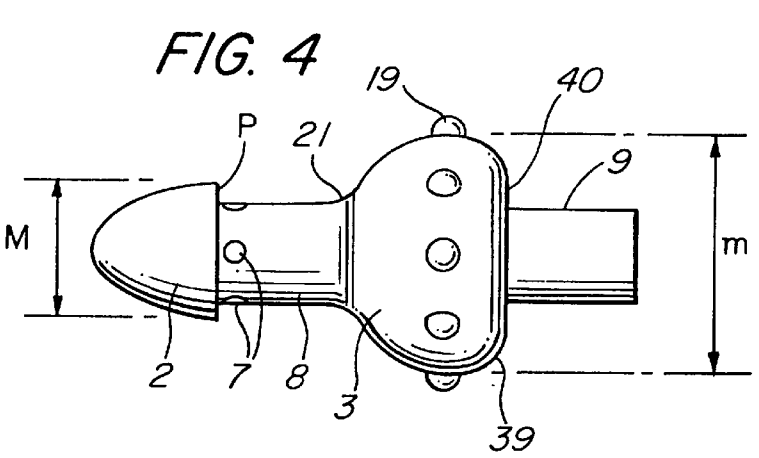
FIG. 4 is a side elevational view of a further embodiment of the mixing device of the present invention, showing a different shaped first element and a different shaped surface of a second element.
Figure 3:
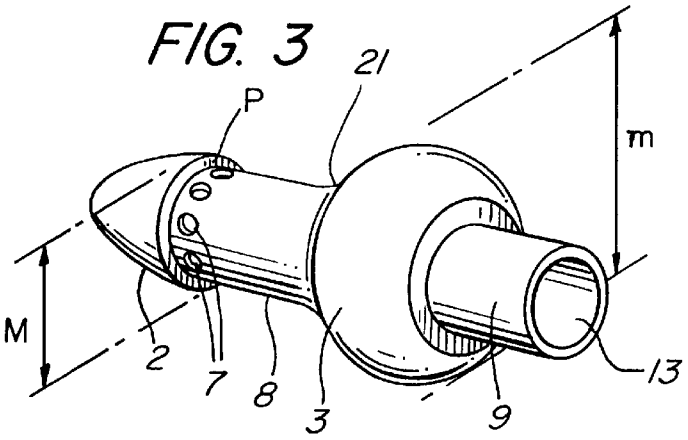
FIG. 3 is a perspective view of the first embodiment of the device of the present invention, looking from the rear.

FIG. 3 shows a preferred embodiment of the mixing device of FIGS. 1 and 2, looking from the rear, while FIG. 4 shows a side elevational view of a second embodiment of the mixing device of the present invention. In the second embodiment of FIG. 4, the first element 2 has a semi-ellipsoidal form, and the second element 3 has a plurality of protrusions 19 formed along an outer periphery of maximum diameter. Protrusions 19 help to improve the atomization of fluid flow passing over the second element 3.

FIG. 5 shows a cross sectional view of the preferred embodiment of the mixing device of the present invention shown in FIG. 3, with the second element 3 having a radius "r1". FIGS. 5A and 5B show that the second element 3 may have different radiuses, "r1" or "r2", and thickness or lengths, with or without surface protrusions 19 formed thereon. The bodies of the second element 3 are interchangeable with each other, so as to obtain a required flow pattern for a given purpose. All of the indicated body shapes still produce the same fluid drawing or pulling effect inside the nozzle. Each of the different bodies of elements 3 include internal passages 13 having a screw threaded portions 38 formed therein. These internal screw threads 38 are selectively screwed over external screw threads 45 formed on the exterior surface at the end of the hollow, cylindrical section 8.

Turning back to FIG. 2, there is also shown a rigid, curved tube 31, that is connected to an outer end of a cylindrical portion 9 by a holding element 43, such as a collar, having an internally screw threaded portion 41 secured over external screw threads 42 formed on the end of cylindrical portion 9, and over a first end of the rigid, curved tube 31. A second end of the rigid, curved tube 31 is secured to a tube 32, which may be plastic and have a plurality of openings formed therein, immersed in the fluid 35, held inside a container 34. Container 34 is supported in any desired manner, such as by a structural L-shaped member 36, which is fixed to the structural section 23 by an annular structural holding element 37. A flow control device 33, such as a push button valve, or the like, is secured to the second end of the rigid, curved tube 31 to control the flow of the fluid solution 35 from the container 34, through tubes 32 and 31, into the internal passage 13 of the second element 3.

Figure 6:
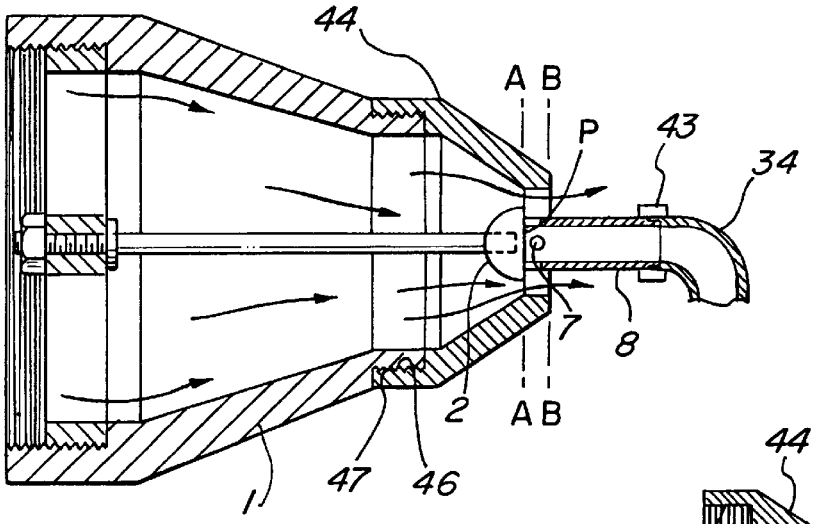
FIGS. 6–6C are cross sectional views of a convergent nozzle having different size cylindrical elements held in the nozzle.
Figure 6A:
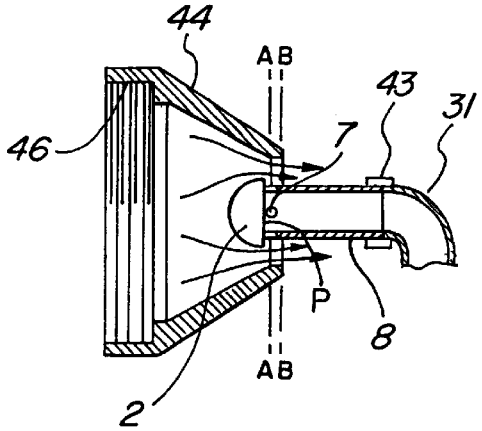
Figure 6B:
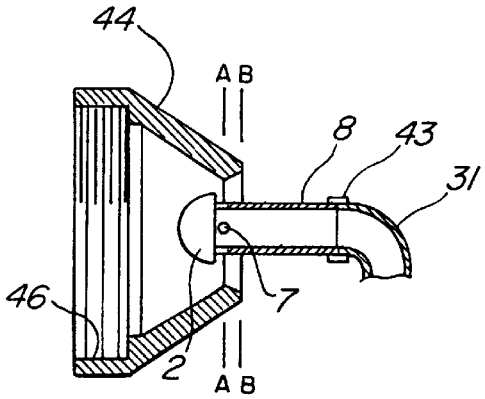
Figure 6C:
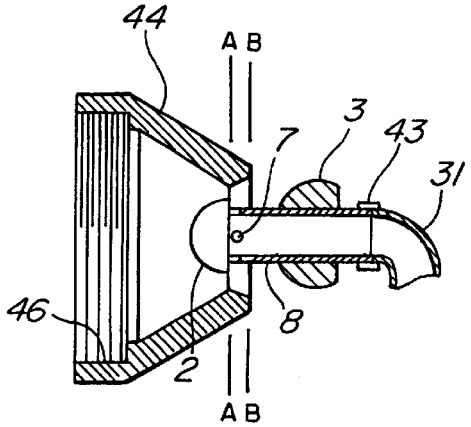

FIGS. 6–6C show further embodiments of the device of the present invention, having a convergent nozzle 44, with the first element 2 held in the convergent nozzle 44 and connected to the cylindrical portion or section 8, and wherein fluid flow expansion between the convergent nozzle and the cylindrical portion still produce a drawing or pulling of a second fluid, without requiring a second element, such as 3. This convergent nozzle 44 includes internal screw threads 46, which screw onto external screw threads 47 on the nozzle body 1. The axial position of the first element 2 is still aligned along the rear surface "p" within the throat of the nozzle, as indicated by the plane A—A. FIGS. 6A–6C show the nozzle 44 in different positions, with respect to the first element 2 and with and without a second element 3, so as to indicate how different flow rates may be obtained using the convergent nozzle 44, by moving the rear surface "p" of the mixing device, with respect to the throat portion of the nozzle, as indicated by plane A—A. In FIG. 6C, a second element 3 is shown added to the elongated body 8 after the first element 2. All sharp edges in the nozzle and mixing element are rounded so as to improve fluid flow therethrough.

It, thus, can be seen that the novel mixing device of the present invention provides an improved mixing of two fluids by a first fluid drawing or pulling a second fluid into itself in a nozzle. The drawing in of the second fluid by the first fluid produces the enhanced mixing of the two fluids, as well as the atomization thereof, when passed over a second element mounted exteriorly of the nozzle.

Those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A spherical mixing device, comprising, in combination:

a first element formed by a convex body of revolution around an axis;

the first element having a smooth, semispherical surface of a selected radius;

a cylindrical, hollow section secured to the first element, along an axis which is coincident with a longitudinal axis of the first element;

a series of openings formed in the cylindrical, hollow section, adjacent to the first element;

a second element formed by a convex body of revolution around an axis;

the second element having a selected radius and being smoothly connected to the cylindrical, hollow section; and a nozzle having the first element placed inside a throat area and axially aligned with a longitudinal axis of the nozzle.

2. The spherical mixing device of claim 1 wherein the first elememt has a semi-ellipsoid shape.

3. The spherical mixing device of claim 2 wherein the cylindrical, hollow section has a lesser maximum diameter than the semi-spherical shaped first element.

4. The spherical mixing device of claim 1 wherein the second element has an annular body of constant radius, and an annular faring, which smoothly joins the cylindrical, hollow section and the second element.

5. The spherical mixing device of claim 1 wherein the second element has a plurality of protrusions formed thereon, perpendicular to the longitudinal axis, which protrusions atomize any fluid flow expanding over the second element.

6. The spherical mixing device of claim 1, further including a cylindrical housing composed of two cylindrical sleeves surrounding the nozzle, the two cylindrical sleeves being axially slidable with respect to each other, by means of threaded portions formed on the two cylindrical sleeves.

7. The spherical mixing device of claim 1 wherein the nozzle is provided with cylindrical, housing sections, which cylindrical housing sections are held together by threads which enable the cylindrical, housing sections to be moved axially, with respect to each other, to produce a change of fluid flow rate.

8. The spherical mixing device of claim 1 wherein the second element is removable and may be replaced by other elements having different sizes and shapes.

9. The spherical mixing device of claim 1 wherein the nozzle has a well-defined exit section, and the second element is mounted adjacent to the exit section.

10. The spherical mixing device of claim 1 wherein the throat area of the nozzle contains a maximum diameter section of the first element, and the nozzle may be moved along the longitudinal axis, in order to change the throat area cross section.

11. A device for mixing a first fluid with a second fluid, comprising, in combination:

a nozzle having a body with a throat section and an exit;

a first element having a curved front end held in the throat section;

an elongated, tubular section having an internal passage, a first end and a second end; the elongated tubular section secured to a rear end of the first element by the first end;

a plurality of openings formed in the elongated, tubular section adjacent to the rear end of the first element, aligned with the throat section; and a second element secured to the second end of the elongated, tubular section, and having a central opening connected to the internal passage to allow a second fluid to be drawn into the internal passage and out through the plurality of openings when a first fluid passes through the nozzle and out the exit.

12. The device of claim 11 wherein the nozzle is a convergent-divergent nozzle, and includes an exterior housing comprised of a plurality of cylindrical elements, which may be selectively rotated with respect to each other.

13. The device of claim 12 wherein the first element has a flat, rear face adjacent to the plurality of openings.

14. The device of claim 13 wherein the plurality of cylindrical elements include a plurality of apertures formed therein.

15. The device of claim 14 wherein the second element is of a different diameter than the first element.

16. The device of claim 15 wherein the second element has a plurality of protrusions formed on an exterior surface thereof.

17. The device of claim 16, further including a shaped, tubular element connected at a first end to the internal passage; and wherein the shaped, tubular element is connected by a second end to a container, having the second fluid therein, which second fluid is drawn into the first fluid.

18. A device for mixing a first fluid with a second fluid, comprising, in combination:

a nozzle having a body with a throat section and an exit opening;

a housing mounted on and surrounding the nozzle;

a first shaped element having a curved front end and a flat, rear end mounted in the throat section;

an elongated, tubular section having an internal passage, a first end and a second end, secured to the flat, rear end by the first end;

a plurality of openings formed in the elongated, tubular section at the first end, adjacent to the flat, rear end for drawing the second fluid into the first fluid, flowing by the first shaped element and out the exit opening; and the elongated, tubular section having a diameter which is smaller that the first shaped element, and extending out through the exit opening.

19. The device of claim 18, further including a second shaped element mounted on the elongated, tubular section, outside of the exit opening to aid in the atomization of mixed fluids exiting from the nozzle.

* * * * *